US007835501B2

(12) United States Patent
Hauttmann et al.

(10) Patent No.: US 7,835,501 B2
(45) Date of Patent: Nov. 16, 2010

(54) X-RAY TUBE, X-RAY SYSTEM, AND METHOD FOR GENERATING X-RAYS

(75) Inventors: Stefan Hauttmann, Buchholz In der Nordheide (DE); Rainer Pietig, Herzogenrath (DE); Jeroen Jan Lambertus Horikx, Weert (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/444,749

(22) PCT Filed: Oct. 9, 2007

(86) PCT No.: PCT/IB2007/054096

§ 371 (c)(1),
(2), (4) Date: Apr. 8, 2009

(87) PCT Pub. No.: WO2008/044196

PCT Pub. Date: Apr. 17, 2008

(65) Prior Publication Data

US 2010/0008470 A1 Jan. 14, 2010

(30) Foreign Application Priority Data

Oct. 13, 2006 (EP) ..... 06122224

(51) Int. Cl.
*H01J 35/04* (2006.01)
*H01J 35/14* (2006.01)
*H01J 35/10* (2006.01)

(52) U.S. Cl. ..... 378/135; 378/138; 378/144

(58) Field of Classification Search ..... 378/135, 378/138, 144

See application file for complete search history.

(56) References Cited

U.S. PATENT DOCUMENTS

| | | | | |
|---|---|---|---|---|
| 2,108,573 | A | 2/1938 | Alfter | |
| 4,130,759 | A | 12/1978 | Haimson | |
| 5,125,019 | A | 6/1992 | Evain et al. | |
| 6,181,771 | B1 | 1/2001 | Hell et al. | |
| 6,356,619 | B1 | 3/2002 | Nagy et al. | |
| 2003/0142790 | A1 * | 7/2003 | Zhou et al. | 378/119 |
| 2004/0150311 | A1 * | 8/2004 | Jin | 313/309 |
| 2005/0185761 | A1 | 8/2005 | Freudenberger et al. | |

FOREIGN PATENT DOCUMENTS

| | | |
|---|---|---|
| DE | 2850583 | 6/1980 |

* cited by examiner

*Primary Examiner*—Irakli Kiknadze

(57) ABSTRACT

According to an exemplary embodiment an x-ray tube comprises a cathode, rotable disc anode, and a focal spot modulating unit, wherein the cathode is adapted to emit an electron beam, and wherein the focal spot modulating unit is adapted to modulate the electron beam in such a way that an intensity distribution of the electron beam on a focal spot on the anode is asymmetric such that the intensity of the electron beam on the focal spot is higher at the front of the focal spot with respect to the rotation direction.

16 Claims, 9 Drawing Sheets

X-RAY TUBE, X-RAY SYSTEM, AND METHOD FOR GENERATING X-RAYS

FIELD OF INVENTION

The invention relates to x-ray tubes, to x-ray systems and methods for generating x-rays. In particular the invention relates to x-ray tubes for x-ray systems like Computer Tomography comprising a rotatable disk anode, wherein a maximum peak temperature of an electron beam focal spot is reduced.

TECHNICAL BACKGROUND

One of the major demands for further Computer Tomography (CT) applications is to scan a heart during its passive state. Necessary for that is a faster gantry rotation and hence a shorter but higher x-ray power pulse. These power peaks are hard to realize with commonly used x-ray tubes. Computed tomography (CT) is a process of using digital processing to generate a three-dimensional image of the internal of an object under investigation (object of interest, object under examination). The reconstruction of CT images can be done by applying appropriate algorithms.

SUMMARY OF THE INVENTION

There may be a need to provide an improved x-ray tube, an x-ray system and a method for generating x-rays.

This need may be met by an x-ray tube, an x-ray system and a method for generating x-rays according to the features of the independent claims.

According to an exemplary embodiment an x-ray tube comprises a cathode, an anode, and a focal spot modulating unit, wherein the cathode is adapted to emit an electron beam, and wherein the focal spot modulating unit is adapted to modulate the electron beam in such a way that an intensity distribution of the electron beam on a focal spot on the anode is asymmetric. In particular an energy distribution of the electron beam impinging the anode may be asymmetric in such a way that on one side of the focal spot the intensity of the electron beam is higher than on the other side of the focal spot leading to an asymmetric intensity distribution of the electron beam on the anode. Such an asymmetric distribution may also be called an inhomogeneous distribution. The cathode may comprise an emitter.

According to an exemplary embodiment an x-ray system comprises an x-ray tube according to an exemplary embodiment of the invention and an x-ray detection unit, wherein the x-ray detection unit is adapted to detect an x-ray beam emitted by the x-ray tube. Such an x-ray system may for example be a Computer Tomography system, a C-arm device, a cardiovascular x-ray device, or a common fluoroscopic device.

According to an exemplary embodiment a method for generating an x-ray beam comprises modulating a direction of the electron emitter within the cathode cup in such a way that the direction of the electron emitter surface normal differs from 0° with respect to an axis of a disk anode, generating an electron beam and impinging the modulated electron beam onto the disk anode.

According to the invention the term "modulating" may refer to every possible modulation or alteration of a typical electron beam. In particular, it may, for example, refer to a change in intensity, energy spectrum or in a direction of the electron beam with respect to the anode, wherein the change may take place before or after generation of the electron beam in the cathode. That is, the electron beam may not impinge the surface of the anode under an angle which is substantially 0° with respect to the axis of the anode, but differs from this perpendicular direction. According to the invention the term "asymmetric" may refer to every asymmetric form of the focal spot on the surface of the anode. In particular, an inhomogeneous distribution may mean, for example in case of a substantially rectangular focal spot, that the intensity of the electron beam may vary along one direction of the rectangular focal spot, while along the other direction of the rectangular focal spot the intensity may be substantially constant. The variation of the intensity may be substantially monotonous along the one direction. Substantially monotonous may mean that after smoothing of the intensity profile the intensity profile is monotonous, wherein the smoothing smears out statistically fluctuations. That is, according to this exemplary embodiment the variation is not in the form of a Gaussian profile, since such a profile is neither asymmetric nor is the variation monotonous.

A gist of the invention may be seen in the aspect that an energy distribution of the focal spot of an electron beam on an anode is shaped in such a way that the maximum focal spot temperature may be reduced. For example a roughly "triangle" shaped function of the energy distribution may be used, which may be better suited to decrease the maximum spot temperature than a homogeneous or Gaussian energy distributions known from the prior art.

By generate an electron beam having an energy or intensity distribution over the focal spot which distribution is asymmetric it may be possible to reduce the maximum temperature as well as the mean temperature the anode is exposed to. Thus, it might be possible to increase the intensity of the power peaks of the x-ray tube without the necessity to increase either the anode diameter and/or to increase a rotating speed of the anode, which necessity may be given by a commonly used x-ray tube. Thus, the limiting factor of mechanical stability of the anode may be bypassed by using an x-ray tube according to an exemplary embodiment.

Further, by reducing the maximum temperature an evaporation rate of anode material into the vacuum of the x-ray tube may be decreased as well, which evaporation causes a higher arcing rate. This decreasing of the temperature may be in particular advantageous since the evaporation rates increases non-linearly with respect to the temperature of the focal spot.

Furthermore, by reducing the maximum temperature the thermo-mechanical stress the anode is exposed to may be reduced, which mechanical stress is induced due to the large temperature gradient induced into the anode, when the temperature is high at the focal spot, i.e. the point the electron actually impinges or hits the anode, and considerably lower at the points the electron beam does not hit the anode. This thermo-mechanical stress may drastically reduce the tube live time because of crack formations on the focal track or may result in an instantaneous anode crack. Thus, by using an x-ray tube according to an exemplary embodiment of the invention it may be possible to increase the life time and durability of the x-ray tube.

In the following, further exemplary embodiments of the x-ray tube will be described. However, these embodiments apply also for the x-ray system and the method for generating x-rays.

According to another exemplary embodiment of the x-ray tube the anode is formed by a rotatable disk anode. Preferably, the rotatable disk anode has a circumference or circumferential direction, wherein the focal spot modulating unit is adapted to generate the asymmetry of the focal spot in such a way that the asymmetry is formed with respect to the circumference. In an illustrative way it may be said that the focal spot has a shape substantially like a rectangular area, i.e. an area having a length and a width. The asymmetry is preferably formed in such a way that the intensity of the electron beam changes along the width direction of the rectangular area which corresponds to the tangential or rotation direction of the rotatable anode, while along the length, i.e. the dimension of the rectangular area which corresponds to the radial direction of the rotatable anode, the intensity distribution is preferably substantially constant.

According to another exemplary embodiment of the x-ray tube the focal spot modulating unit is adapted to generate the asymmetry in such a way that the intensity of the electron beam on the focal spot is higher at a front portion of the focal spot with respect to the rotating direction. The front edge of the focal spot is the edge of the focal spot which is the first portion that enters the region which is impinged by the electron beam, i.e. the region which is newly exposed to the electron beam. In particular, the intensity profile along the width may be monotonous decreasing from the front edge to the back edge of the area on which the focal spot impinges, however small statistical fluctuations may be overlaid to the monotonous decreasing without departing from the spirit of this exemplary embodiment. That is, the monotonous behavior is more clearly visible in the smoothed intensity profile. In particular, an intensity distribution may be called asymmetric in case that the intensity at the back portion is less than 60% of the intensity at the front portion. Preferably, the intensity at the back portion is approximately between 50% and 20% of the intensity at the front portion, for example the intensity at the back portion is about 30% of the intensity at the front portion.

By providing such an intensity profile along the width direction it may be possible to efficiently decrease the maximum focal spot temperature as well as the mean focal spot temperature, which may lead to an increased intensity of the generated x-ray beam without the need of increasing the focal spot temperature as it is necessary when using an x-ray tube according to the prior art.

According to another exemplary embodiment of the x-ray tube the focal spot modulating unit is adapted to modulate a direction of the electron emitter with respect to a rotation axis of the rotatable disk anode in such a way that a starting direction of the electrons deviates or differs from 0° with respect to the rotation axis. In particular, the deviation angle is preferably in the tangential direction, i.e. in a plane, which is formed by a tangent to the outer edge of the anode and by the parallel shifted rotation axis, wherein the plane passes through the focal spot. Preferably, the deviation in the angle is between 0° and 2°, more preferably the deviation in the angle is between 0.5° and 1°. The deviation or shift in the angle may also be called deflection. The change in the focal spot intensity distribution may result from the asymmetric optical behavior within the cathode cup, i.e., due to the slight deviation in the starting direction, focusing components arranged between the cathode and the anode work in such a way that an intensity distribution within the focal spot may correspond to an asymmetric intensity distribution, while an impinging direction of the modulated electron beam may only be slightly altered.

The provision of a deflection angle between 0° and 2° and particular the provision of a deflection angle between 0.5° and 1° may be an efficient way to generate an asymmetric focal spot intensity profile on the rotatable anode, which may lead to a decreased maximum focal spot temperature.

According to another exemplary embodiment the modulating unit is adapted to tilt the cathode with respect to the rotatable disk anode in such a way that a starting direction of the electrons with respect to an rotation axis of the rotatable disk anode differs from 0°. In particular, the deviation angle is in the tangential direction, i.e. in a plane, which is formed by a tangent to the outer edge of the anode and by a line parallel to the rotation axis, wherein the plane passes through the focal spot. That is, the deflection angle between 0° and 2° or between 0.5 and 1° may be generated by tilting the cathode with respect to the rotation axis of the rotatable anode, i.e. the electron beam is emitted under the deflection.

According to another exemplary embodiment the focal spot modulating unit is adapted to generate a fixed tilting angle of the cathode and/or the emitter.

The using of a fixed tilting angle, i.e. a tilting angle which is not changeable, for example, by using a mechanically fixed tilting angle, may be an efficient way to provide a simple and easy to manufacture x-ray tube having a predetermined intensity profile.

According to another exemplary embodiment the focal spot modulating unit is adapted to generate a variable tilting angle of the cathode and/or the emitter. In particular, the focal spot modulating unit may comprise a control element, wherein the control element is adapted to vary the tilting angle. Preferably, the control element comprises a piezoelectric-element, which may be adapted to tilt the cathode, in particular an emitter of the cathode. Preferably, the cathode, more particularly the emitter, may be only fixed weakly at its base which may lead to the fact that the emitter is easily tilted by the piezoelectric-element.

The provision of a control unit which is adapted to shift or tilt the cathode or the emitter may be an efficient way to adapt the intensity profile of the focal spot to different application and different situations, so that for different applications an optimized intensity profile may be providable. In particular, the provision of a variable tilting angle may be advantageous in applications in which the effect of exceeding temperature limits occurs only for high power pulses.

According to another exemplary embodiment of the x-ray tube the focal spot modulating unit comprises a magnetic unit, wherein the magnetic unit is adapted to generate a magnetic field. Preferably, the magnetic unit is adapted to generate a magnetic hexapole field. In particular, the magnetic unit may be arranged half-way between the cathode and the anode.

The provision of a magnetic unit, i.e. a unit which generate a magnetic field, may be an efficient way to modulate or affect the electron beam already emitted by the cathode. Preferably, an electromagnet is used however a permanent magnet may also be applicable to modulate or act on the electron beam.

According to another exemplary embodiment the focal spot modulating unit comprises a grid electrode. The grid electrode may be implemented in a cathode cup of the cathode. Preferably, the grid electrode has a fixed tilt with respect to the rotation axis of the rotatable disk anode. Alternatively, the grid electrode has a variable tilt with respect to the rotation axis of the rotatable disk anode. Preferably, the tilt of the grid electrode is in the same plane as described above with respect to the tilt in the emitter direction. The grid electrode may act as an electrostatic lens and aberrations caused by the tilt of the electron grid may cause the asymmetry in the intensity distribution of the focal spot.

Preferably, in both cases, i.e. the variable tilt and the fixed tilt, the deviation in the angle is between 0° and 2°, more preferably the deviation in the angle is between 0.5° and 1°. The deviation or shift in the angle may also be called deflection angle. Preferably, the deviation is in the direction of the circumference of the anode, i.e. the tangential direction.

The provision of a deflection angle between 0° and 2° and particular the provision of a deflection angle between 0.5° and 1° may be an efficient way to generate an asymmetric focal spot intensity profile on the rotatable anode, which may lead to a decreased maximum focal spot temperature.

An x-ray tube according to an exemplary embodiment of the invention may be applicable in any field in which an electron beam hits a target with a relative movement of the focal spot. In particular, the x-ray tube may be applicable in the field of cardiovascular devices and Computer Tomography devices.

Summarizing an exemplary aspect of the invention may be seen in the fact that an electron beam intensity distribution on an anode of an x-ray tube is modulated in such a way that a maximum temperature on the anode is decreased. For that the intensity distribution of the focal spot may be adjusted in such a way that each point of the focal spot is exposed to the highest intensity at the beginning of its exposure, while during the further exposure the intensity is decreasing. Theoretically, the intensity should be adjusted in such a way that the temperature at the anode is held constant during the whole exposure. However, due to physical restrictions this may not possible, so that only a decreasing intensity of the electron beam impinging each point on the anode may be possible, leading to a more constant temperature and thus to a reduced maximum temperature.

These and other aspects of the present invention will become apparent from and will be elucidated with reference to the exemplary embodiments described hereinafter.

BRIEF DESCRIPTION OF THE DRAWINGS

Exemplary embodiments of the present invention will be described in the following, with reference to the following drawings.

DETAILED DESCRIPTION OF AN EXEMPLARY EMBODIMENT

Figure 1:
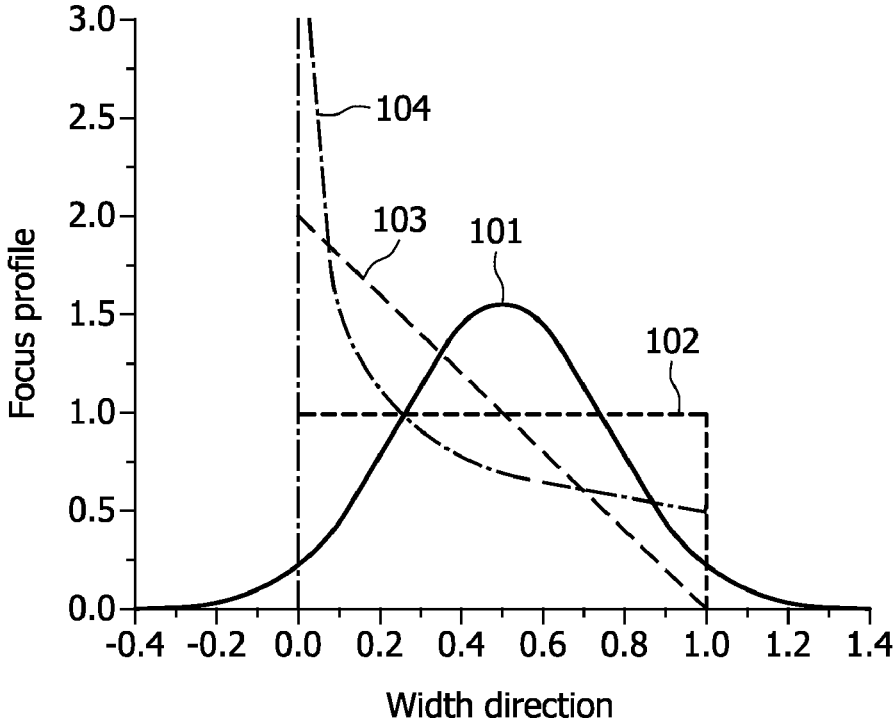
FIG. 1 shows schematic diagrams of different focal spot profiles and of resulting temperature profiles.
Figure 1:
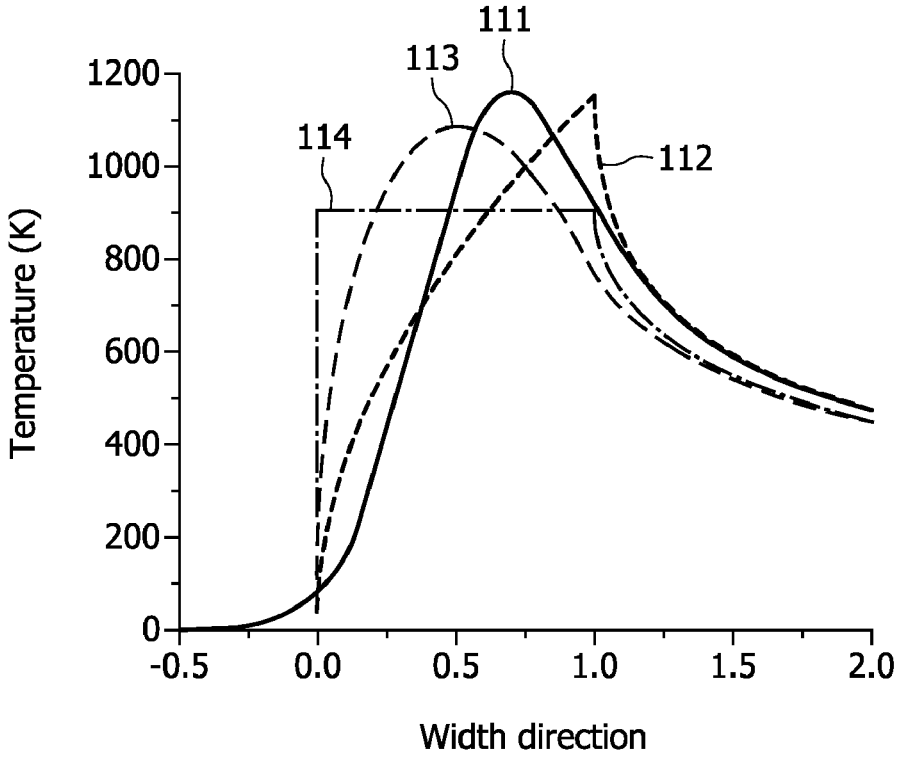

The illustration in the drawings is schematically. In different drawings, similar or identical elements are provided with similar or identical reference signs.

FIG. 1 shows schematic diagrams of different focal spot intensity profiles (FIG. 1A) and of resulting temperature profiles (FIG. 1B). The intensity profile is shown dependent on a width in circumferential direction of an anode of an x-ray tube. FIG. 1A shows the focal spot intensity for four different profiles over the width. The reference sign 101 refers to a Gaussian profile, i.e. an intensity profile according to a Gaussian distribution. The reference sign 102 refers to a constant profile, i.e. an intensity profile which exhibits a constant intensity value along the width of the focal spot. The constant intensity of this profile is set to the value of 1. The reference sign 103 refers to a linear profile, i.e. an intensity profile which exhibits a linear decrease in intensity over the width of the focal spot. The reference sign 104 refers to an optimized profile, i.e. an intensity profile which exhibits a decrease in intensity over the width of the focal spot, which results in an optimized temperature profile, which is shown in FIG. 1B. All four curves are normalized, i.e. the integral of the intensity is the same for all four intensity profiles.

Out of these intensity profiles shown in FIG. 1A the corresponding temperature profiles shown in FIG. 1B are calculated. The calculation is described hereinafter.

When an electron beam spot hits a surface, e.g. an anode, energy is deposited within a thin surface layer of a few micrometer. This deposition is a very fast process. Thus, a thermal conduction sets in due to the induced temperature gradient. However, the thermal conduction is quite slow, i.e. the thermal energy is distributed within the target very slowly, leading to a fast temperature increase at the anode surface. To reduce this problem the anode is typically rotated and hence each point in the focal track is illuminated only for a short time of a few microseconds. However, due to an increasing demand on peak power, the resulting temperature peaks in the focal spot are at the limit of the known anode technology.

In the prior art it is known to increase the anode rotation speed or the anode diameter. However, according to an exemplary embodiment of the invention the maximum temperature is reduced by shaping the intensity distribution of the focal spot. In particular, the profile in length direction, which is perpendicular to the anode movement, should preferably be rectangular, i.e. the intensity should be constant, to possibly keep the temperature as low as possible. However, in width direction, which is in the moving or rotation direction of the anode, the situation is per se less clear. According to known x-ray tubes, symmetrical spot shapes are used. However, according to an exemplary embodiment intensity distributions are used which are asymmetric in width directions.

For a spot whose width direction is small compared to its length direction and whose profile is rectangular in length direction, the temperature along the width direction within the focus spot can be calculated by:

$$T(x) = \frac{W_0 b}{2\pi c_v D}\int_0^1 dy\, w(y) e^{-\frac{vb}{2D}(x-y)} K_0\left(\frac{vb}{2D}|x-y|\right)$$

wherein:

w(y) denotes: the spot profile in width direction (normalized to 1);

$W_0$ denotes: incident power;

$c_v$ denotes: specific heat per volume;

D denotes: thermal diffusivity;

b denotes: spot width;

v denotes: focal track velocity; and $K_0$ denotes: the zero order Neumann function.

According the above function the temperature profiles of the intensity profiles shown in FIG. 1A are calculated and shown in FIG. 1B. The graph labelled 111 corresponds to the Gaussian intensity profile 101 of FIG. 1, while the graph labelled 112 corresponds to the constant intensity profile 102 of FIG. 1A. Both intensity profiles result in a substantially equal maximum temperature of about 1150° C. The graph labelled 113 corresponds to the linear decreasing intensity 103 of FIG. 1A, while the graph labelled 114 corresponds to the optimized intensity profile 104 of FIG. 1A. Both of these intensity profiles result in a reduced maximum temperature, wherein in the case of the optimized intensity profile the maximum temperature is reduced about 30% compared with the resulting maximum temperature of the constant intensity profile, wherein the optimized intensity profile relates to a theoretical intensity distribution profile which leads to a constant temperature along the whole width of the focal spot. Thus, a significant reduction in the maximum temperature can be achieved, if the intensity distribution profile of the focal spot is not symmetrical but has a larger weight at the "front" with respect to the moving direction. That is, each point on the anode, which point is exposed to the electron beam, is exposed to the highest intensity of the electron beam at the beginning of exposure.

Figure 2:
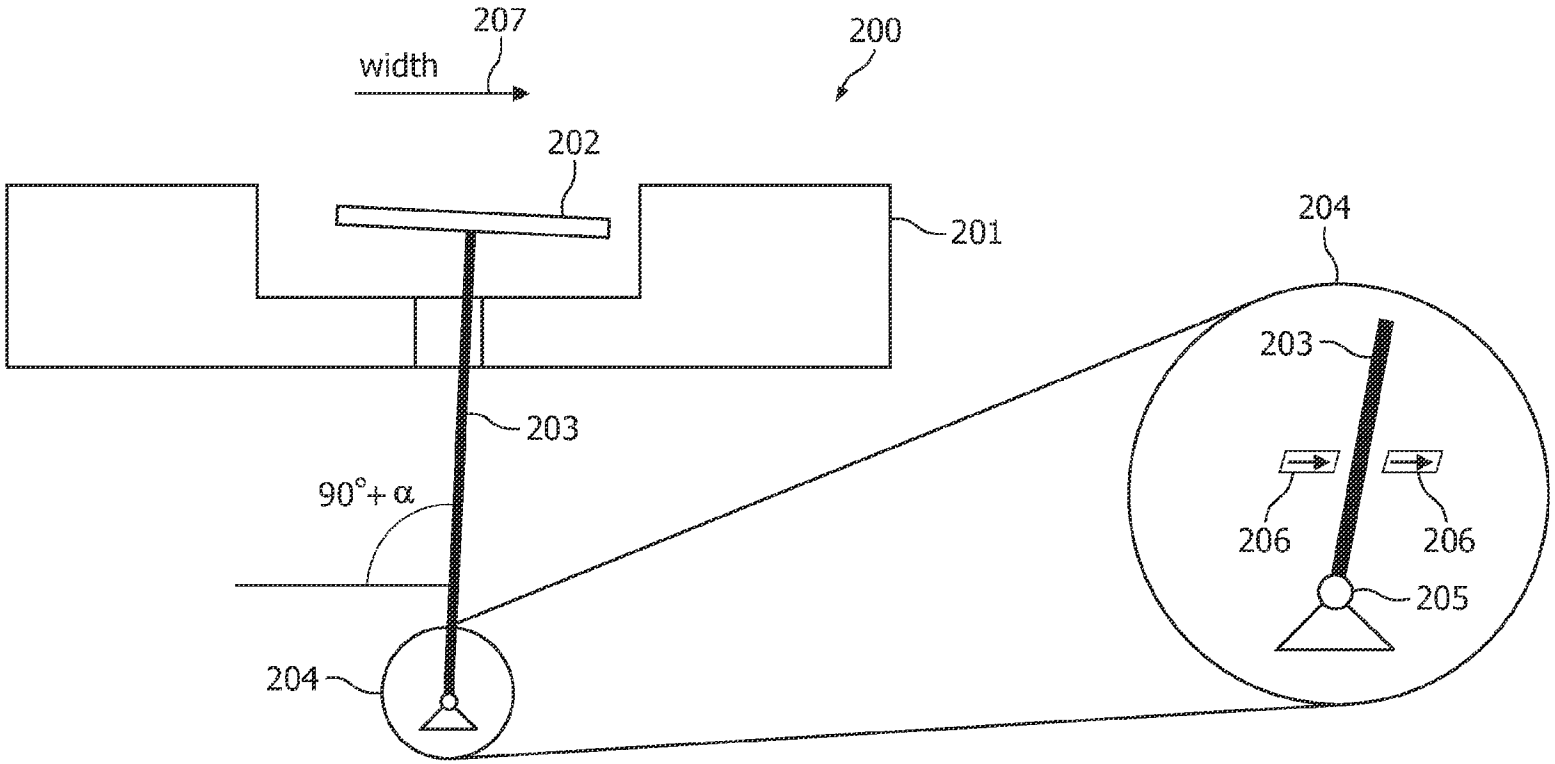
FIG. 2 shows a schematic drawing of a cathode or emitter tilting mechanism according to an exemplary embodiment.

In FIG. 2 shows a schematic drawing of a cathode or emitter tilting mechanism according to an exemplary embodiment. In FIG. 2 a cathode 200 is shown having a cathode cup 201 and a substantially planar emitter 202, wherein the emitter 202 is arranged in a recess of the cathode cup 201. The emitter 202 is fixed to a rod 203 which in turn is weakly fixed at its base 204. The base 204 is shown in more detail in the enlarged view on the right. In this enlarged view a part of the rod 203 is shown which is pivotable fixed to a base, which is schematically shown by the dot 205 which represents an articulation. Furthermore, a piezoelectric element 206 is schematically shown which is adapted to pivot or swivel the rod and thus the emitter 203 by a predetermined angle, wherein the pivoting is done in the width direction of the focal spot on the anode, which is schematically indicated by the arrows 207 in FIG. 2.

By tilting the emitter inside the cathode cup like it is shown in FIG. 2 it may be possible to change the intensity profile in the width direction of the focal spot. This change substantially does not change the intensity profile along the length direction. Small values of tilting or deviation angles of approximately $0.5° < a < 1.0°$ may be sufficient to get significant changes. In this case a represents the deviation angle, i.e. the difference to a perpendicular orientation between the rod 203 and the width direction. as schematically shown in FIG. 2.

The resulting intensity distribution profiles are shown in FIG. 3. The tilting of the emitter may be, as shown, realized by using piezoelectric elements which shift the emitter terminal width with respect to the width direction. This variable tilt may in particular be advantageous, since the effect of exceeding a temperature limit occurs predominantly only for high power pulses. However, the tilt may also be realized by a mechanically fixed tilt, i.e. a fixed fixation having a predetermined unchangeable deviation angle $\alpha$.

FIG. 3 shows the resulting intensity profiles for three different tilting angles in two-dimensional representations and one dimensional histograms.

Figure 3A:
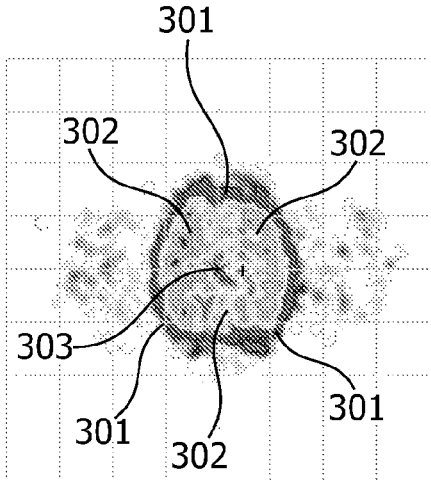
FIG. 3 shows resulting intensity distributions for different tilting angles.

FIG. 3A shows the two-dimensional intensity profile for a tilting angle $\alpha$ of zero degree, i.e. in the case the emitter is not shifted and the rod of FIG. 2 is perpendicular to the width direction. The abscissa in FIG. 3A corresponds to the width of the focal spot, while the ordinate corresponds to the length of the focal spot. In FIG. 3A the intensity distribution is roughly circular, which corresponds to a roughly constant intensity profile. However, smaller variations in the intensity profile can be seen. In particular, the boundary 301 of the circle is shown darker, which relates to a smaller intensity than the intensity in the lighter areas 302 of FIG. 3A. Furthermore, also in the central part 303 a slightly smaller intensity is given, which can also be seen due to the points of darker colours 303 in the centre of the circular distribution. However, the shown distribution is approximately symmetric with respect to the centre of the focal spot.

Figure 3B:
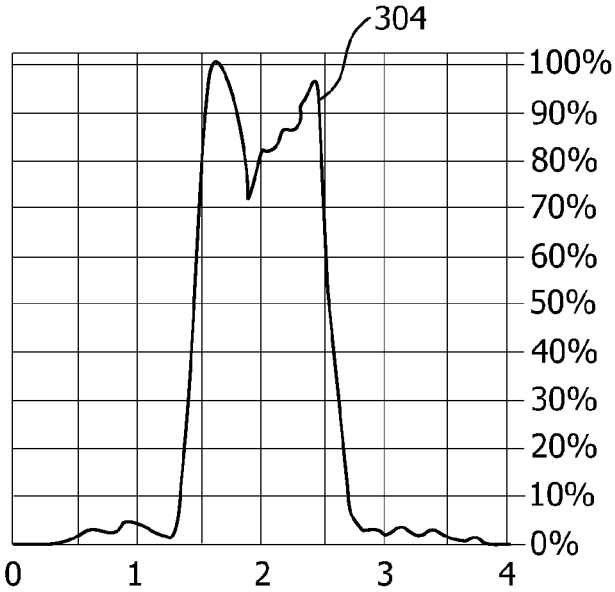

FIG. 3B shows the histogram 304 which correspond to the two-dimensional intensity profile of FIG. 3A. The abscissa in FIG. 3B also corresponds to the width direction. The histogram 304 is calculated by integrating the two-dimensional intensity profile of FIG. 3A, i.e. for each width value the intensity values corresponding to all lengths values are summed. Along the width direction small fluctuations are shown in the profile, but the corresponding intensity profile is still approximately symmetric. In particular, the intensity is approximately the same at the front and at the back of the focal spot, i.e. for a width value of 1.5 and for a width value of 2.5.

Figure 3C:
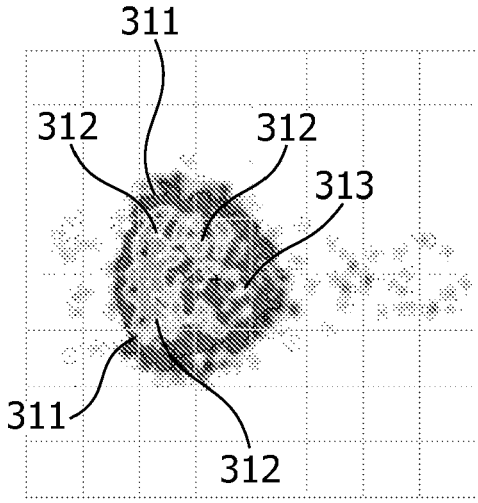

FIG. 3C shows the two-dimensional intensity profile for a tilting angle $\alpha$ of 0.5 degrees, i.e. in the case the emitter is tilted. The abscissa in FIG. 3C corresponds to the width of the focal spot, while the ordinate corresponds to the length of the focal spot. In FIG. 3C the intensity distribution is less circular than in the case of FIG. 3A which corresponds to a less symmetrical intensity profile. The intensity profile exhibits more variations and thus results in a more asymmetric intensity distribution. In particular, the boundary 311 of the circle is shown darker, which relates to a smaller intensity than the intensity in the lighter areas 312 of FIG. 3C. However, the lighter areas 312, i.e. the areas which are exposed to an electron beam of higher intensity are shifted or concentrated to the front portion of the focal spot, i.e. to the left in FIG. 3C, while the back portions 313 of the focal spot are shown darker, which corresponds to a lower intensity. Thus, the overall intensity distribution shown in FIG. 3C is less symmetric. This can be seen ever more clearly in the histogram shown in FIG. 3D, which corresponds to the integrated two-dimensional diagram of FIG. 3C.

Figure 3D:
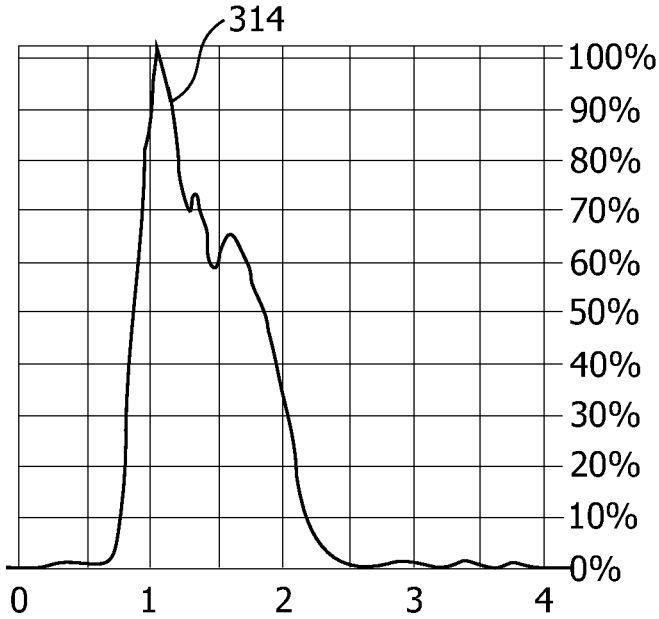

The abscissa in FIG. 3D also corresponds to the width direction. Along the width direction clear variations are shown in the profile 314 leading to an asymmetric intensity distribution. In particular, the intensity is quite different at the front and at the back of the focal spot, i.e. for a value of the width of 1.0 and for a value of about 1.9 at which point the intensity is about 40% of the value at the width of 1.0.

Figure 3E:
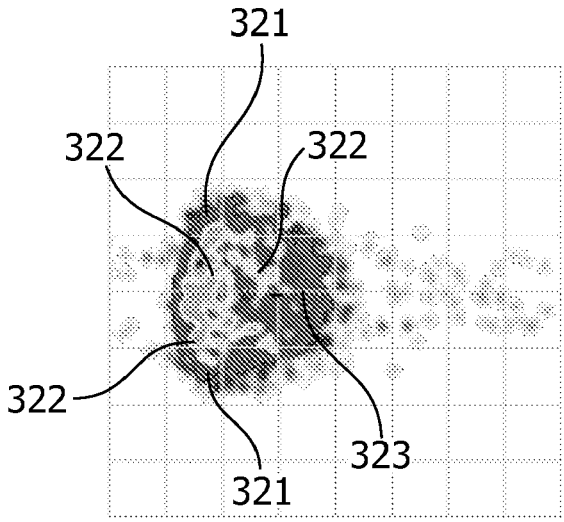

FIG. 3E shows the two-dimensional intensity profile for a tilting angle $\alpha$ of 0.75 degrees, i.e. in the case the emitter is tilted. The abscissa in FIG. 3E corresponds to the width of the focal spot, while the ordinate corresponds to the length of the focal spot. In FIG. 3E the intensity distribution is even less circular than in the case of FIG. 3C which corresponds to an even less symmetrical intensity profile. The intensity profile exhibits more variations and thus results in a more asymmetric intensity distribution. In particular, the boundary 321 of the circle is shown darker, which relates to a smaller intensity than the intensity in the lighter areas 322 of FIG. 3E. However, the lighter areas 322, i.e. the areas which are exposed to an electron beam of higher intensity are shifted or concentrated even more to the front portion of the focal spot, i.e. to the left in FIG. 3E, while the back portions 323 of the focal spot are shown darker, which corresponds to a lower intensity. Thus, the overall intensity distribution shown in FIG. 3E is less symmetric. This can be seen even more clearly in the histogram 324 shown in FIG. 3F, which corresponds to the integrated two-dimensional diagram of FIG. 3E.

Figure 3F:
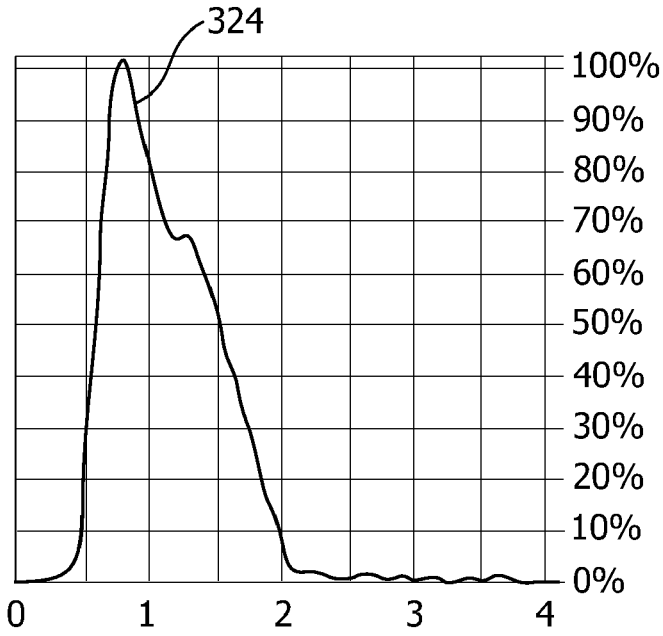

The abscissa in FIG. 3F also corresponds to the width direction. Along the width direction more pronounced variations are shown in the profile leading to a quite asymmetric intensity distribution. In particular, the intensity is quite different at the front and at the back of the focal spot, i.e. for a value of the width of 0.6 and for a value of about 1.9 at which point the intensity is about 25% of the value at the width of 0.8.

Figure 4:
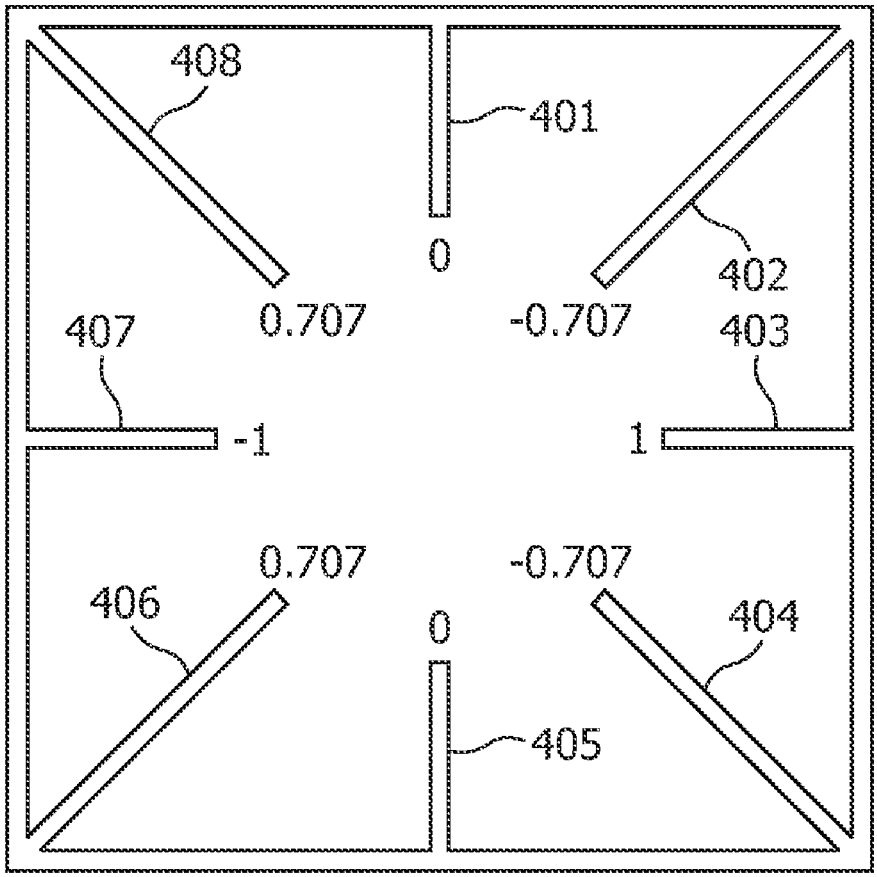
FIG. 4 shows a schematic drawing of a magnetic unit generating a hexapole field which can be used in an x-ray tube according to an exemplary embodiment.

FIG. 4 shows a schematic drawing of a magnetic unit generating a hexapole field which can be used in an x-ray tube according to an exemplary embodiment. The focal spot shapes according to an exemplary embodiment may also be generated by providing a magnetic hexapole lens as shown in FIG. 4. The resulting spot shapes and corresponding temperature profiles are shown in FIG. 5. FIG. 4 shows schematically the excitations required to create a unit hexapole field in different directions. In a first direction 401 the magnetic field has a strength of 0. In a second direction 402, corresponding to a direction of 45°, the magnetic field has a strength of about −0.707 or −sin(45°). At a third direction 403, corresponding to a direction of 90°, the magnetic has a strength of about 1. In a fourth direction 404, corresponding to a direction of 135°, the magnetic field has a strength of about −0.707 or −sin (135°). In a fifth direction 405, corresponding to a direction of 180°, the magnetic field has a strength of 0. In a sixth direction 406, corresponding to a direction of 225°, the magnetic field has a strength of about 0.707 or −sin(225°). At a seventh direction 407, corresponding to a direction of 270°, the magnetic has a strength of about −1. In an eighth direction 408, corresponding to a direction of 315°, the magnetic field has a strength of about 0.707 or −sin(315°). The magnetic hexapole is preferably arranged halfway between the emitter and the anode. In the magnetic unit shown in FIG. 4 eight poles are used to generate a magnetic hexapole field, i.e., an octopole element is excited in such a manner as to generate a hexapole field. Magnetic units with a different number of poles can also be used to generate a magnetic hexapole field. However, such a unit must have at least six poles in order to be able to generate a magnetic hexapole field of sufficient purity.

FIG. 5 shows the resulting intensity and temperature distributions on the anode disc for different strengths of a magnetic hexapole. FIG. 5A shows a resulting two-dimensional intensity distribution profile for the case of a magnetic hexapole field of zero strength, i.e. an excitation of the magnetic unit of 0 ampere turn. On the abscissa the length in mm is shown, while on the ordinate the width in mm is shown. In FIG. 5A areas of high intensity 501, 502, 503, 504 and 505 and areas of low intensity 506, and 507. FIG. 5B shows the intensity distribution as a function of width value, integrated over the length direction. The abscissa of FIG. 5B corresponds to the value of the width in mm of the focal spot of FIG. 5A. In FIG. 5B a symmetric intensity distribution is shown, having two peaks near the boundaries of the focal spot and a minimum in the centre of the width parameter. FIG. 5B shows two graphs 508 and 509, wherein the graph 509 represents the smoothed graph 508. FIG. 5C shows the resulting temperature 510 over the width of the focal spot. In particular the maximum temperature is shown over the width. In FIG. 5C, i.e. at a strength of the magnetic hexapole field which corresponds to an excitation of 0 ampere turns, the maximum temperature corresponds to a temperature increase of about 23.4° K at a width of a little less than 0.5 mm.

Figure 5A:
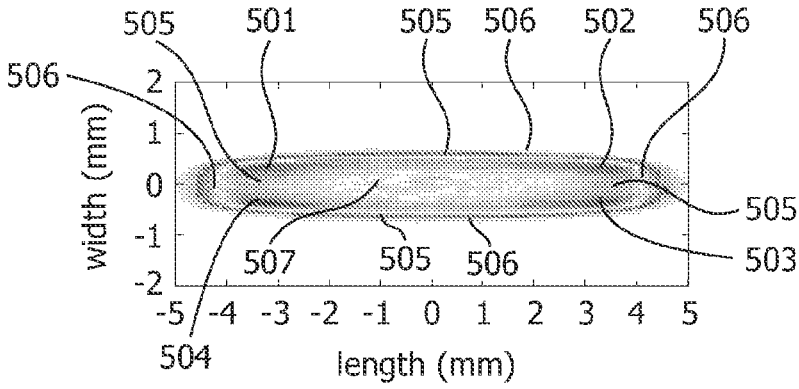
FIG. 5 shows resulting intensity and temperature distributions for different strengths of a magnetic hexapole field.
Figure 5B:
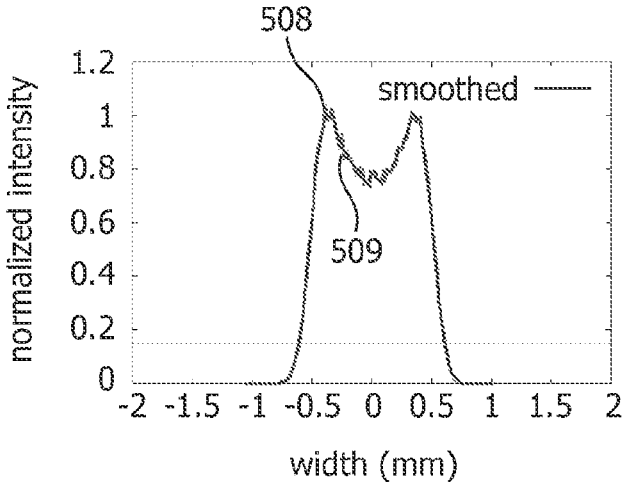
Figure 5C:
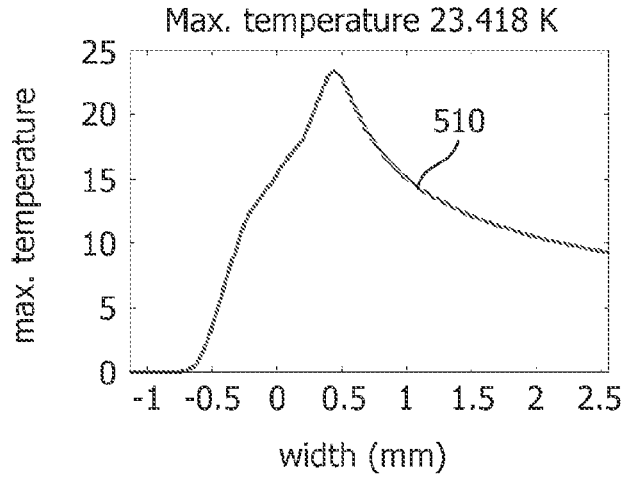
Figure 5D:
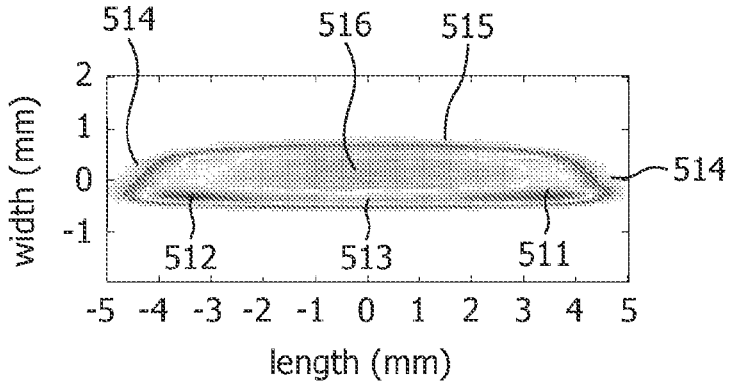
Figure 5E:
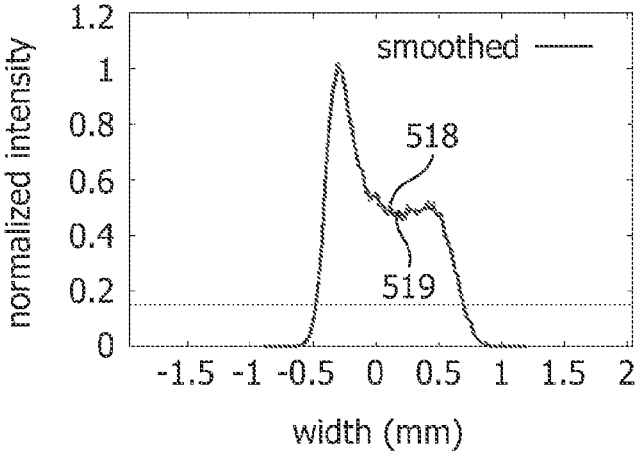
Figure 5F:
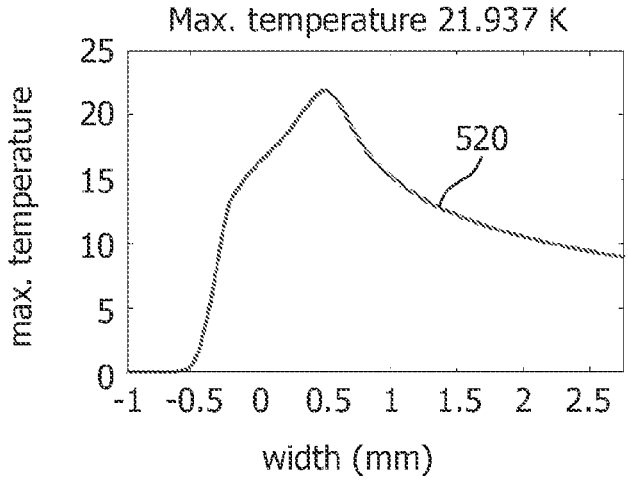

FIG. 5D shows a resulting two-dimensional intensity distribution profile for the case of a magnetic hexapole field corresponding to an excitation of −20 ampere turn. On the abscissa the length in mm is shown, while on the ordinate the width in mm is shown. In FIG. 5D areas of high intensity 511, 512, and 513 and areas of low intensity 514, 515 and 516. FIG. 5E shows the intensity distribution as a function of width value, integrated over the length direction. The abscissa of FIG. 5E corresponds to the value of the width in mm of the focal spot. In FIG. 5E an asymmetric intensity distribution is shown, having one peak near the front boundary of the focal spot and a decreasing intensity towards the centre of the width parameter. FIG. 5E shows two graphs 518 and 519, wherein the graph 519 represents the smoothed graph 508. FIG. 5F shows the resulting temperature 520 over the width of the focal spot. In particular the maximum temperature is shown over the width. In FIG. 5F, i.e. at a strength of the magnetic hexapole field which corresponds to an excitation of −20 ampere turns, the maximum temperature corresponds to a temperature increase of about 21.9° K at a width of about 0.5 mm, which is about 0.94 times the temperature of the 0 ampere turns case shown in FIG. 5C.

Figure 5G:
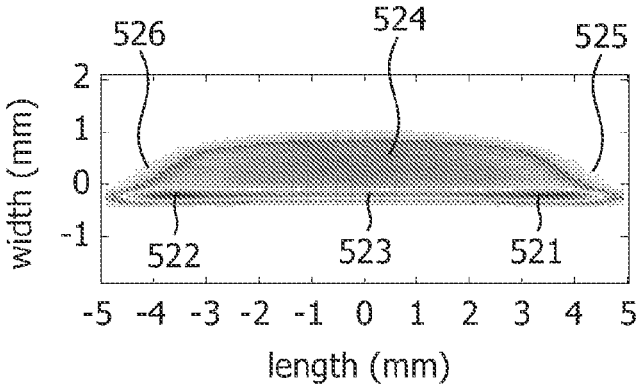
Figure 5H:
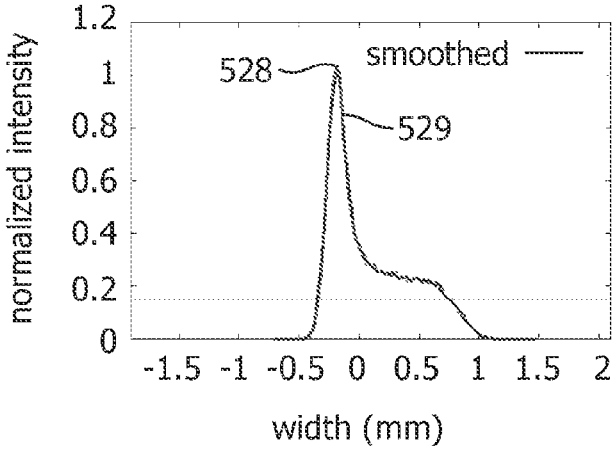

FIG. 5G shows a resulting two-dimensional intensity distribution profile for the case of a magnetic field having −50 ampere turn. On the abscissa the length in mm is shown, while on the ordinate the width in mm is shown. In FIG. 5G areas of high intensity 521, 522, and 523 and areas of low intensity 524, 525 and 526. FIG. 5H shows the intensity distribution as a function of width value, integrated over the length direction.

Figure 5I:
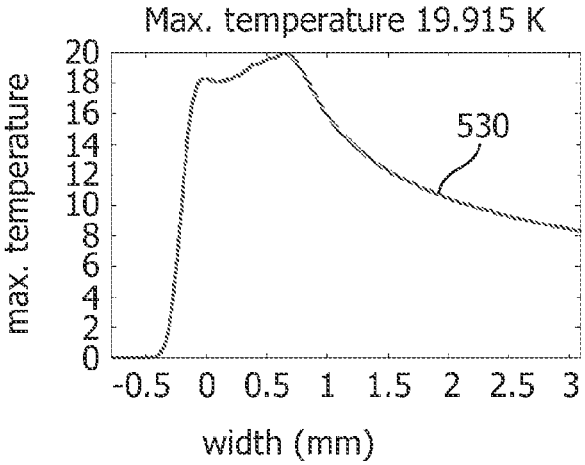

The abscissa of FIG. 5H corresponds to the value of the width in mm of the focal spot. In FIG. 5H an asymmetric intensity distribution is shown, having one peak near the front boundary of the focal spot and a decreasing intensity towards the centre of the width parameter. FIG. 5H shows two graphs 528 and 529, wherein the graph 529 represents the smoothed graph 528. FIG. 5I shows the resulting temperature 530 over the width of the focal spot. In particular the maximum temperature is shown over the width. In FIG. 5H, i.e. at a strength of the magnetic hexapole field which corresponds to an excitation of −50 ampere turns, the maximum temperature corresponds to a temperature increase of about 19.9° K at a width of about 0.7 mm. which is about 0.85 times the temperature of the 0 ampere turns case shown in FIG. 5C. Summarizing the intensity distribution corresponding to a magnetic field of −50 ampere turns is more asymmetric than in the case of a magnetic field of −20 ampere turns, which results in a decreased maximum temperature.

According to another exemplary embodiment the desired asymmetric intensity distribution is generated by introducing a grid electrode into the cathode cup which grid electrode is slightly tilted similar to the exemplary embodiment shown in FIG. 2, i.e. similar to the tilting of the emitter. The grid electrode would act as an electrostatic lens and aberrations caused by its tilt would have the desired spot intensity asymmetry as a result.

It should be noted that the term "comprising" does not exclude other elements or steps and the "a" or "an" does not exclude a plurality. Also elements described in association with different embodiments or different aspects may be combined. It should also be noted that reference signs in the claims shall not be construed as limiting the scope of the claims.

The invention claimed is:

1. An x-ray tube comprising:

a cathode;

an anode; and a focal spot modulating unit;

wherein the cathode is adapted to emit an electron beam, wherein the focal spot modulating unit is adapted to modulate the electron beam in such a way that an intensity distribution of the electron beam on a focal spot on the anode is asymmetric, wherein the asymmetric intensity distribution on the focal spot includes a highest intensity at a beginning of exposure of each point of the focal spot and a decreasing intensity during further exposure, and wherein the focal spot modulating unit further comprises a magnetic hexapole lens arranged between the cathode and the anode to generate a shape of the focal spot having the asymmetric intensity distribution.

2. The x-ray tube according to claim 1, wherein the anode is formed by a rotatable disk anode.

3. The x-ray tube according to claim 2, wherein the rotatable disk anode has a circumference, wherein the focal spot modulating unit is adapted to generate the asymmetry of the focal spot in such a way that the asymmetry is formed with respect to the circumference.

4. The x-ray tube according to claim 2, wherein the focal spot modulating unit is adapted to modulate a direction of the electron emitter with respect to a rotation axis of the rotatable disk anode in such a way that a starting direction of the electrons deviate from 0° with respect to the rotation axis.

5. The x-ray tube according to claim 4, wherein the deviation in the angle is between 0° and 2°.

6. The x-ray tube according claim 4, wherein the deviation in the angle is between 0.5° and 1°.

7. The x-ray tube according to claim 2, wherein the modulating unit is adapted to tilt the cathode with respect to the rotatable disk anode in such a way that a direction of the electron beam with respect to a rotation axis of the rotatable disk anode differs from 0°.

8. The x-ray tube according to claim 2, wherein the focal spot modulating unit is adapted to generate a fixed tilting angle of the cathode and/or the emitter.

9. The x-ray tube according to claim 2, wherein the focal spot modulating unit is adapted to generate a variable tilting angle of the cathode and/or the emitter.

10. The x-ray tube according to claim 9, wherein the focal spot modulating unit comprises a control element, wherein the control element is adapted to vary the tilting angle.

11. The x-ray tube according to claim 10, wherein the control element comprises a piezoelectric element.

12. The x-ray tube according to claim 2, wherein the focal spot modulating unit comprises a grid electrode.

13. The x-ray unit according to claim 12, wherein the grid electrode has a fixed tilt with respect to the rotation axis of the rotatable disk anode.

14. The x-ray unit according to claim 12, wherein the grid electrode has a variable tilt with respect to the rotation axis of the rotatable disk anode.

15. An x-ray system comprising:

an x-ray tube according to claim 1, an x-ray detection unit, wherein the x-ray detection unit is adapted to detect an x-ray beam emitted by the x-ray tube.

16. A method for generating an x-ray beam, the method comprising:

generating an electron beam, modulating a direction of the electron beam in such a way that the direction of the electron beam differs from 90° with respect to an axis of a disk anode, and impinging the modulated electron beam onto a focal spot of the disk anode, wherein modulating the electron beam includes modulating via a focal spot modulating unit, the focal spot modulating unit adapted to create an asymmetric intensity distribution of the electron beam on the focal spot, wherein the asymmetric intensity distribution on the focal spot includes a highest intensity at a beginning of exposure of each point of the focal spot and a decreasing intensity during further exposure, and wherein the focal spot modulating unit further comprises a magnetic hexapole lens arranged between the cathode and the anode to generate a shape of the focal spot having the asymmetric intensity distribution.

* * * * *